US008800909B2

(12) United States Patent
Morinaga

(10) Patent No.: US 8,800,909 B2
(45) Date of Patent: Aug. 12, 2014

(54) SHEET-SUPPLY DEVICE AND IMAGE FORMING APPARATUS INCORPORATING SAME

(75) Inventor: Shigeru Morinaga, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 780 days.

(21) Appl. No.: 12/947,308

(22) Filed: Nov. 16, 2010

(65) Prior Publication Data

US 2011/0114691 A1 May 19, 2011

(30) Foreign Application Priority Data

Nov. 17, 2009 (JP) ..... 2009-261928

(51) Int. Cl.
*B65H 57/04* (2006.01)

(52) U.S. Cl.
USPC ..... 242/566; 242/615.3; 400/613

(58) Field of Classification Search
USPC ..... 242/595, 615, 615.3, 565, 566; 400/613
See application file for complete search history.

(56) References Cited

U.S. PATENT DOCUMENTS 3,834,638 A * 9/1974 Savage et al. ..... 242/541.3
6,230,999 B1 * 5/2001 Tanaka ..... 242/578.2
6,345,782 B1 * 2/2002 Nakayama et al. ..... 242/564.4
7,553,098 B2 * 6/2009 Maekawa et al. ..... 400/613
2008/0135674 A1 * 6/2008 Takeuchi ..... 242/598.5
2009/0114758 A1 * 5/2009 Yamada ..... 242/566

FOREIGN PATENT DOCUMENTS

| | | |
|---|---|---|
| JP | 58-115322 | 7/1983 |
| JP | 60-120077 | 6/1985 |
| JP | 63-51254 | 3/1988 |
| JP | 2000-128402 | 5/2000 |
| JP | 2000-272794 | 10/2000 |
| JP | 2001-302051 | 10/2001 |
| JP | 2004-230710 | 8/2004 |

OTHER PUBLICATIONS

Japanese official action dated Oct. 2, 2013 in corresponding Japanese patent application No. 2009-261928.

* cited by examiner

*Primary Examiner* — William A Rivera
(74) *Attorney, Agent, or Firm* — Cooper & Dunham LLP

(57) ABSTRACT

A sheet-supply device internally defining a supply route through which to supply a sheet. The sheet-supply device includes a supply member to supply the sheet from a rolled long sheet, a guide member to guide the sheet to the supply member, provided upstream in a direction in which the sheet is moved to the supply member and, movable between a guide position at which the sheet is guided to the supply member and an escape position at which the guide member is away from the supply route of the sheet.

16 Claims, 12 Drawing Sheets

SHEET-SUPPLY DEVICE AND IMAGE FORMING APPARATUS INCORPORATING SAME

CROSS-REFERENCE TO RELATED APPLICATIONS

This patent specification claims priority from Japanese Patent Application No. 2009-261928, filed on Nov. 17, 2009 in the Japan Patent Office, the entire contents of which are hereby incorporated by reference herein.

BACKGROUND OF THE INVENTION

1. Field of the Invention

The present invention relates to a sheet-supply device and an image forming apparatus incorporating the sheet-supply device.

2. Discussion of the Background

Certain sheet-supply devices installed in image forming apparatuses such as copiers, printers, facsimile machines and multifunction peripherals machines (MPF) use a roll of paper, that is, a single rolled long sheet.

In one example of a sheet-supply device proposed in JP-2001-302051-A, when a new roll of paper is installed in the sheet-supply device so that a recording sheet from the roll of paper can be supplied, a distal end of the sheet from the roll of paper is manually sent to a supply roller along a guide member provided in a main body of the sheet-supply device.

FIG. 20 is a schematic diagram illustrating a known sheet-supply device 800 using a roll of paper 500. In FIG. 20, reference numeral 100 designates a sheet that is pulled out from the roll of paper 500, 200 designates an upper guide, 300 designates a lower guide, and 400 designates a pair of supply rollers. The upper guide 200 and the lower guide 300 function as guide members.

In this example, in order to install a new roll of paper 500 into the sheet-supply device 800 so that the sheet 100 unreeled from the roll of paper 500 can be supplied, the sheet 100 pulled out from the roll of paper 500 is inserted between a tip 200*a* of the upper guide 200 and a tip 300*a* of the lower guide 300, and a distal end of the sheet 100 is passed between the upper guide 200 and the lower guide 300 to the pair of supply rollers 400. An entrance sensor (not shown) is provided in front of the pair of the supply rollers 400 (left side in FIG. 21A). When the entrance sensor detects the sheet 100, the pair of supply roller 400 rotates, the distal end of the sheet 100 is clamped between the pair of supply rollers 400, and thus, the sheet 100 can be supplied.

However, in the sheet-supply device 800 shown in FIG. 20, as the sheet 100 is supplied and the sheet remaining in the roll 500 is reduced, as shown in FIG. 21A, the position of the sheet 100 unreeled from an outer circumferential face of the roll 500 is moved from a position A shown in FIG. 21A to a position A' shown in FIG. 21A. Accordingly, a supply route of the sheet 100 is changed from a route indicated by the broken line shown in FIG. 21A to a route indicated by the solid line shown in FIG. 21A. As a result, the sheet 100 strongly interferes with the tip 200*a* of the upper guide 200, and the sheet 100 is damaged, which is a problem. Furthermore, as shown in FIG. 21B, when the supply of the sheet 100 is continued and the sheet 100 is fully unreeled from the roll 500, an adhesion portion between a proximal end of the sheet 100 and a core of the roll 500 is exposed. At this time, the sheet 100 further strongly interferes with the tip 200*a* of the upper guide 200, which causes load for the sheet 100 to be greatest.

In order to prevent these problems, as shown in FIG. 22 a short length of an upper guide 201 can be used in a sheet-supply device 801 to alleviate interference between the sheet 100 pulled from the roll 500 and the upper guide 201.

However, in the configuration in which the upper guide 201 is shortened, when the sheet 100 unreeled from a new roll 500 is set in the sheet-supply device 801, the degree of visibility of a tip 201*a* of the upper guide 201 is low from outside because the tip 201*a* is hidden by the new roll 500 indicated by broken lines shown in FIG. 22. Accordingly, the distal end of the sheet 100 unreeled from the new roll 500 is less likely to be inserted into a gap between the upper guide 201 and the lower guide 300, and it becomes difficult to visually detect whether or not the sheet 100 of the roll 500 is correctly set in the sheet-supply device 801.

In view of foregoing, interference between a sheet and a guide member is undesirable, and accordingly, there is a need for a technology to realize improving workability and visibility when the sheet is set in a sheet-supply device in an image forming apparatus.

SUMMARY OF THE INVENTION

In view of the foregoing, one illustrative embodiment of the present invention provides a sheet-supply device internally defining a supply route through which to supply a sheet. The sheet-supply device includes a supply member to supply the sheet from a rolled long sheet and a guide member to guide the sheet to the supply member. The guide member is provided upstream in a direction in which the sheet is moved to the supply member and movable between a guide position at which the sheet is guided to the supply member and an escape position at which the guide member is away from the supply route of the sheet.

Another illustrative embodiment of the present invention provides a sheet-supply device internally defining a supply route through which to supply a sheet. The sheet-supply device includes a supply member to supply the sheet from a rolled long sheet and a cover unit to pivot around the rolled long sheet, provided upstream in a direction in which the sheet is moved to the supply member. The cover unit includes a guide member to guide the sheet to the supply member and a protective cover to protect the rolled long sheet, connected to the guide member. The cover unit is movable between a guide position at which the sheet is guided to the supply member and an escape position at which the guide member is away from the supply route of the sheet.

Another illustrative embodiment of the present invention provides an image forming apparatus that includes an image forming device to perform image formation on a sheet and the sheet-supply device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
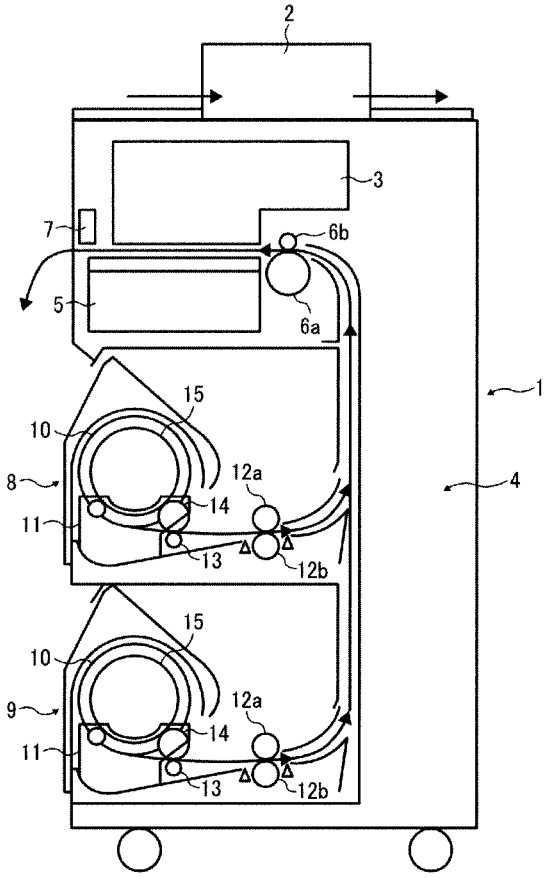
FIG. 1 is a schematic diagram illustrating an ink-jet image forming apparatus incorporating sheet-supply devices according to an illustrative embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, particularly to FIGS. 1 through 8, an image forming apparatus according to an illustrative embodiment of the present invention is described below.

(Configuration of Image Forming Apparatus)

FIG. 1 is a schematic diagram illustrating a configuration of an image forming apparatus incorporating sheet-supply devices.

In FIG. 1, reference numeral 1 represents the image forming apparatus that in the present embodiment is an ink jet printer (hereinafter also simply "the printer"). The main body of the printer 1 includes an image reading unit 2, and an image forming unit 3, and a sheet feeder 4.

In the image reading unit 2, a document placed on a document tray (not shown) is fed to an image reading position at which a contact image sensor (not shown) is provided so that an image in the document is scanned by the contact image sensor, and then, the document thus scanned is discharged to a discharge tray.

The image forming unit 3 forms an image on a recording sheet S by ejecting ink droplets from an ink jet head (not shown) installed in a carriage onto the recording sheet S.

Beneath the image forming unit 3, a suction board 5 to suction the recording sheet S when the recording sheet S is placed thereon is disposed. Multiple small pores (not shown) are formed at predetermined intervals on a top face of the suction board 5. The recording sheet S is fully attracted to the top face of the suction board 5 by sucking air through the small pores, which prevents the recording sheet S from floating and bending.

A pair of feeding rotary members 6*a* and 6*b*, serving as conveyance members to convey the recording sheet S, is disposed upstream from the suction board 5 in a direction in which the recording sheet S is conveyed (right side in FIG. 1). The lower rotary member 6*a* is a conveyance-driving roller that drives the upper rotary member 6*b* to rotate, and the upper rotary member 6*b* is a conveyance-pressure roller that is pressed against the conveyance-driving roller 6*a*, by a pressure member (not shown). In addition, in order to cut the recording sheet S, a cutter unit 7 is disposed downstream from the suction board 5 (left side in FIG. 1).

In the sheet feeder 4, two sheet-supply devices 8 and 9 are vertically arranged. Each of the sheet supply devices 8 and 9 includes a roll tray 11, rotary members 12*a* and 12*b*, a rewind roller 13, a pair of relay rollers 14 (see FIG. 2) and a pair of roll supporters 15.

Each roll supporter 15 supports a roll of paper 10, that is, a rolled long sheet (recording sheet S), and is put on the roll tray 11. The rotary members 12*a* and 12*b* function as supply members to supply the recording sheet S from the roll of paper 10. The rewind rollers 13 function as rewind members to rewind the roll of paper 10. The relay rollers 14 are disposed between the roll supporter 15 and the rewind rollers 13, respectively. The rotary members 12*a* and 12*b* respectively serve as supply members. The rotary member 12*a* is a supply roller that rotates, and the rotary member 12*b* is a supply-pressure roller that is pressed to the supply roller 12*a* by a pressing member (not shown).

In the inkjet printer 1 shown in FIG. 1, in order to facilitate replacement of the rolls of paper 10, the rolls of paper 10 are disposed on a front side of the main body of the printer 1 (left side in FIG. 1). In addition, in the present embodiment, the rolls of paper 10 are disposed beneath the image forming unit 3, and the supply rollers 12*a* are disposed on a backside (inside) of the main body of the printer 1 (right side shown in FIG. 1). Therefore, a height of the main body of the printer 1 can be reduced, and a conveyance path of the recording sheet S can be shortened to prevent skewing of the recording sheet S as it is unreeled from the roll of paper 10.

It is to be noted that the configuration of the present specification is not limited to that shown in FIG. 1. For example, the configuration of the present specification may be adapted to printers including an electrophotographic image forming device as well as other types of image forming apparatuses, such as copiers, facsimile machines, multifunction peripherals (MFP), and the like.

Next, referring to FIG. 1, a basic operation of the above-described printer 1 is described below.

When a printing instruction is received, one of the two sheet-supply devices 8 and 9 of the sheet feeder 4 is selected, and the sheet feeder 4 starts feeding the recording sheet S from the selected sheet-supply device 8 or 9.

For example, when the upper sheet-supply device 8 is selected, the recording sheet S pulled out from the roll of paper 10 is conveyed to the conveyance-driving roller 6*a* and the conveyance-pressure roller 6*b* by rotating the supply roller 12*a* and the supply-pressure roller 12*b*. Subsequently, a distal end (leading edge) of the recording sheet S is aligned by the stopped conveyance-driving roller 6*a* and conveyance-pressure roller 6*b* to correct skew. Then, the recording sheet S is conveyed to the suction board 5 by rotating the conveyance-driving roller 6*a* and the conveyance-pressure roller 6*b* and is temporary stopped thereon. In the suction board 5, the recording sheet S is attracted to the top face of the suction board 5 by sucking air through the small pores (not shown).

In this state, the image forming unit 3 forms images on the recording sheet S while moving along the recording sheet S in a width direction of the recording sheet S (a direction orthogonal to the surface of paper on which FIG. 1 is drawn), in accordance with image data of the document read by the image reading unit 2 or image data acquired from an image data device (not shown) connected to the printer 1. Then, the conveyance-driving roller 6*a* and the conveyance-pressure roller 6*b* restart rotating, and the recording sheet S is further conveyed downstream. Thus, the image forming unit 3 repeats image formation.

Subsequently, after the image formation on the recording sheet S is finished, the recording sheet S is cut and separated by the cutter unit 7. It is to be noted that the portion of the recording sheet S thus cut and separated from the roll of paper 10 is stocked on a discharge tray (not shown).

After the above-described printing operation is finished, the conveyance-driving roller 6*a* and the supply roller 12*a* are rotated in reverse. At this time, the rewind roller 13 rotates, and the roll supporter 15 is rotated in a direction in which the recording sheet S is rewound (reverse direction of the rotation direction during image forming) by transmitting the driving force of the rewind roller 13 to the roll supporter 15 via the relay rollers 14.

Thus, the sheet feeder 4 prepares for the next printing instruction by rewinding the recording sheet S to move back the distal end of the recording sheet S to the conveyance-driving roller 6*a*. In addition, when the next printing is performed by using the other roll of paper 10 (in the lower sheet-supply device 9), the recording sheet S is rewound to the supply roller 12*a* by the upper sheet-supply device 8.

Next, referring to FIGS. 2 through 4, the configuration of the sheet supply device (8 or 9) according to a first embodiment is described below.

Figure 2:
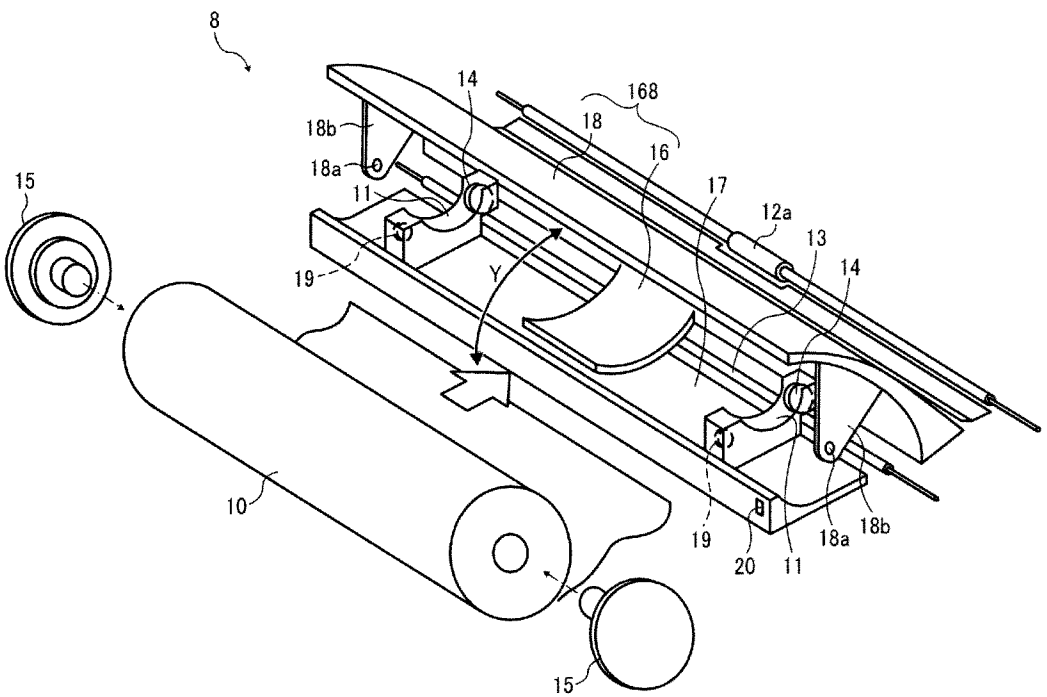
FIG. 2 is a perspective diagram illustrating a configuration of the sheet-supply device shown in FIG. 1.
Figure 3:
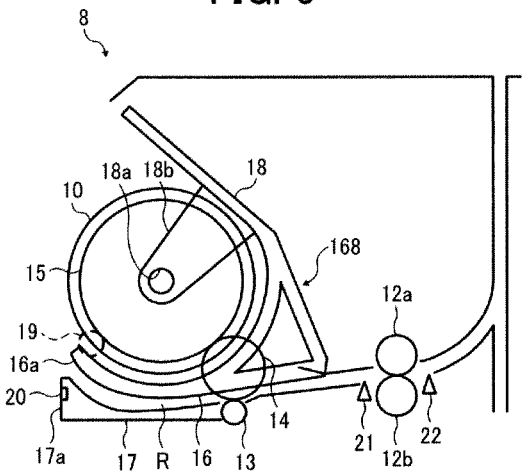
FIG. 3 is a schematic diagram illustrating the sheet-supply device shown in FIG. 2 when a protective cover is opened.
Figure 4:
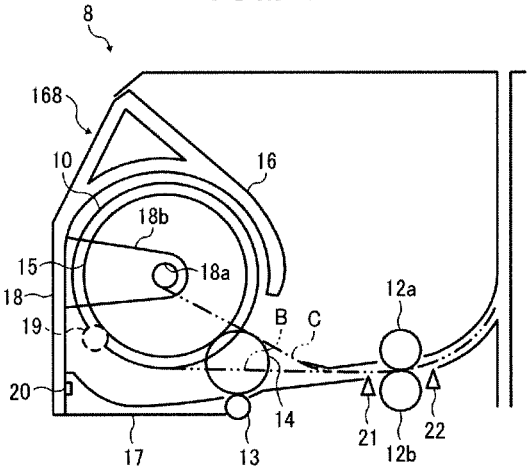
FIG. 4 is a schematic diagram illustrating the sheet-supply device shown in FIG. 3 when the protective cover is closed.

In FIG. 2, a front side (near side) of the main body of the printer 1 is at the bottom left in FIG. 2 and on the left side in FIGS. 3 and 4. It is to be noted that, in the following description, since configurations of elements of the sheet-supply device 8 and those of the sheet-supply device 9 shown in FIG. 1 are substantially identical to each other, in some cases, elements of the upper sheet-supply device 8 are described as representative, and therefore, the description of the lower sheet supply device 9 is omitted.

As shown in FIG. 2, the sheet-supply device 8 includes a cover unit 168 that is formed with a protective cover 18 and an upper guide 16. The protective cover 18 of the cover unit 168 is an openably closable to the rolled long sheet 10. Two projection plates 18*b* in which through-holes 18*a* are formed respectively are provided in the both ends of the protective cover 18. A support shaft (not shown) disposed in the main body of the printer 1 is inserted into the two through-holes 18*a*. With this configuration, the protective cover 18 of the cover unit 168 can rotate around the support shaft provided around the roll of paper 10 in a direction indicated by arrow Y shown in FIG. 2. That is, the cover unit 168 can pivot around the roll of paper 10 when opening and closing.

In addition, the sheet-supply device 8 includes the upper guide 16 and a lower guide 17 functioning as guide members to guide the recording sheet S pulled out from the roll of paper 10. The upper guide 16 is integrally formed with (connected to) the protective cover 18 in the cover unit 168. Therefore, the upper guide 16 rotates with the protective cover 18 around the support shaft that supports the protective cover 18. On the other hand, the lower guide 17 is fixed to the main body of the printer 1.

The two roll trays 11 are disposed on a top face of the lower guide 17, and the relay rollers 14 and support rollers 19 are rotatably attached to the respective roll trays 11. The roll trays 11 are arranged at a predetermined interval from each other. More specifically, both roll trays 11 are positioned to receive the two roll supporters 15 attached to center positions of the cylinder in both ends of the roll of paper 10. Therefore, when the rolls of paper 10 are set on the roll trays 11, the roll supporters 15 contact the relay rollers 14 and the support rollers 19 provided in the respective roll trays 11 (see FIGS. 3 and 4).

In this state, as the rewind roller 13 rotates, the relay rollers 14 driven by the rewind roller 13 cause the roll supporters 15 to rotate in the direction in which the recording sheet S is rewound, and the support rollers 19 are rotated with the rotation of the roll supporter 15.

As shown in FIG. 2, a cover sensor 20, serving as a detector to detect opening and closing of the protective cover 18, is provided on a front side of one end in a longitudinal direction of the lower guide 17. In addition, as shown in FIGS. 3 and 4, an entrance sensor 21 is provided in front of the supply roller 12*a* and the supply-pressure roller 12*b*, and an exit sensor 22 is provided behind the supply roller 12*a* and the supply-pressure roller 12*b*.

FIG. 3 shows the sheet-supply device 8 when the protective cover 18 of the cover unit 168 is opened. As shown in FIG. 1, in a state in which the protective cover 18 is opened, the protective cover 18 is positioned above and on the back of the roll of paper 10 provided in the sheet-supply device 8, and the upper guide 16 is positioned between the roll of paper 10 and the lower guide 17.

In this state, since the upper guide 16 is located at a predetermined interval from the top face of the lower guide 17, a guide path R through which the recording sheet S pulled out from the roll of paper 10 is guided to the supply roller 12*a* is formed between the upper guide 16 and the lower guide 17. Further, in this embodiment, in the open state shown in FIG. 3, a front end 16*a* of the upper guide 16 is aligned with or is located forward of a front face of the outer circumferential surface of the roll of paper 10 installed in the printer 1 in a horizontal direction. Similarly, a front end 17*a* of the lower guide 17 is aligned with or is positioned forward of the front face of the outer circumferential surface of the roll of paper 10 installed in the printer 1 in the horizontal direction.

By contrast, FIG. 4 shows the sheet-supply device 8 when the protective cover 18 of the cover unit 168 is closed. As shown in FIG. 4, in a state in which the protective cover 18 is closed, the protective cover 18 is positioned in front of the roll of paper 10 installed in the sheet-supply device 8, and the upper guide 16 is positioned above and at the back of the roll of paper 10.

In this state, the protective cover 18 contacts the cover sensor 20 provided on the lower guide 17, and therefore, the cover sensor 20 detects that the protective cover 18 is closed.

Herein, a position at which the recording sheet S is pulled out from the outer circumferential face of the roll of paper 10 approaches a center portion thereof as the amount of paper (recording sheet S) remaining in the roll of paper 10 is reduced, and accordingly, a supply route of the recording sheet S formed when the protective cover 18 is closed changes.

In FIG. 4, broken lines B represents a supply route when the paper remaining in the roll of paper 10 is greatest, and broken lines line C represents a supply route when the paper remaining in the roll of paper 10 is lowest. As can be seen from FIG. 4, the supply route of the recording sheet S is changed significantly from the route represented by the broken lines B (hereinafter "supply route B") to the route represented by an broken lines C (hereinafter "supply route C"). In this embodiment, the upper guide 16 is located at the position shown in FIG. 4, that is, the upper guide 16 is located at the position away from the conveyance area for the recording sheet S, through which the supply route moves from the supply route B when the paper remaining in the roll of paper 10 is greatest to the supply route C when the paper remaining in the roll of paper 10 is lowest (area defined by the supply routes B and the supply route C).

That is, when the protective cover 18 is closed, the upper guide 16 enters an escape state in which the upper guide 16 is at "an escape position" away from the supply route (B and C) of the recording sheet S. By contrast, when the protective cover 18 is opened, the upper guide 16 enters a guide state in which the protective cover 18 is at "a guide position" and the guide path R to guide the recording sheet S is formed between the lower guide 17 and the upper guide 16. Thus, in the present embodiment, as the protective cover 18 opens and closes, the upper guide 16 is movable between the guide position and the escape position in conjunction with the protective cover 18.

Next, referring to FIGS. 5 through 8, installation of the roll of paper 10 in the sheet-supply device 8 according to the present embodiment so that the sheet-supply device 8 can supply the recording media S is described below.

Figure 5:
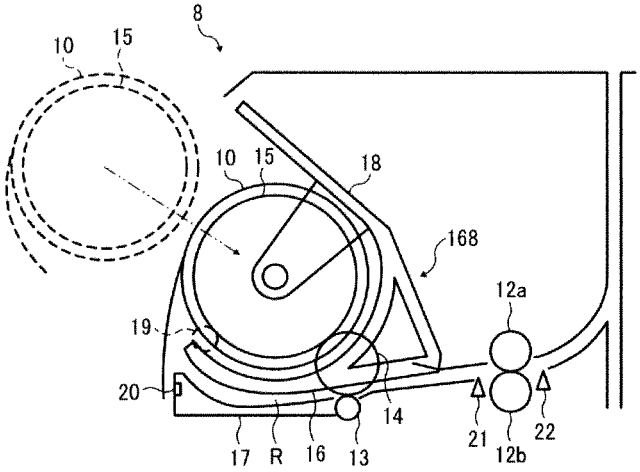
FIG. 5 shows the sheet supply device shown in FIG. 3 when a roll of paper is installed in the sheet supply device in a state in which the protective cover is opened.

Initially, as shown in FIG. 5, the protective cover 18 of the cover unit 168 is opened, and then, a front side of the sheet-supply device 8 is opened. More specifically, the cover unit 168 is rotated in a direction in which the protective cover 18 is opened, the upper guide 16 is moved from the escape position shown in FIG. 4 to the guide position shown in FIG. 5.

Then, the roll of paper 10 whose both ends are clamped by the roll supporter 15 attached thereto is inserted into the opening portion of the sheet-supply device 8, and the roll of paper 10 is set in the sheet-supply device 8 so that the outer circumferential face of the roll of paper 10 contacts the respective outer circumferential faces of the relay rollers 14 and the support rollers 19.

Figure 6:
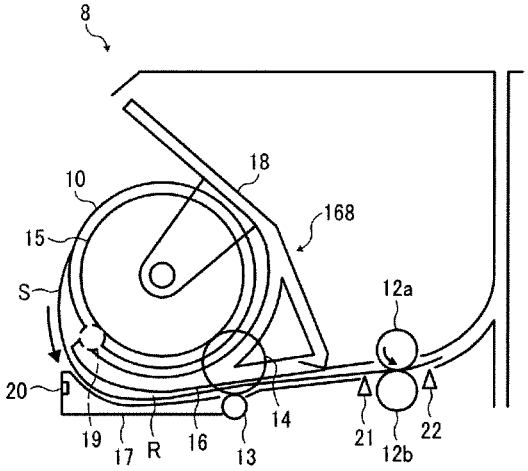
FIG. 6 shows the sheet supply device shown in FIG. 3 when a recording sheet from the roll of paper is inserted into gap between guides.

Next, as shown in FIG. 6, the recording sheet S pulled out from the roll of paper 10 is manually inserted into the guide path R formed between the upper guide 16 and the lower guide 17, and the recording sheet S is moved further inside along the guide path R. Subsequently, when the distal end of the recording sheet S is detected by the entrance sensor 21, the rotation of the supply roller 12*a* is started.

Further, when the recording sheet S is moved further inside and the distal end of the recording sheet S is clamped between the supply roller 12*a* and the supply-pressure roller 12*b*, the recording sheet S is conveyed by the supply roller 12*a* and the supply-pressure roller 12*b*. Then, when the distal end of the recording sheet S is detected by the exit sensor 22, the supply roller 12*a* stops rotating, and the sheet-supply device 8 enters a standby state.

Figure 7:
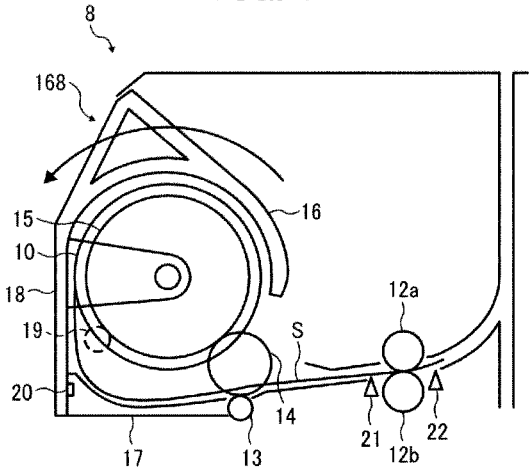
FIG. 7 shows the sheet supply device shown in FIG. 3 when the protective cover is fully closed.

After the sheet-supply device 8 enters the standby state, as shown in FIG. 7, the protective cover 18 of the cover unit 168 is rotated frontward as indicated by an arrow in FIG. 7 and is closed. When fully closed, the protective cover 18 contacts the cover sensor 20, and as a result, the cover sensor 20 detects that the protective cover 18 is in a closed state. In addition, as the protective cover 18 is closed (the cover unit 168 is rotated in a direction in which the protective cover 18 is closed), the upper guide 16 is moved from the guide position shown in FIG. 6 to the escape position shown in FIG. 7.

Figure 8:
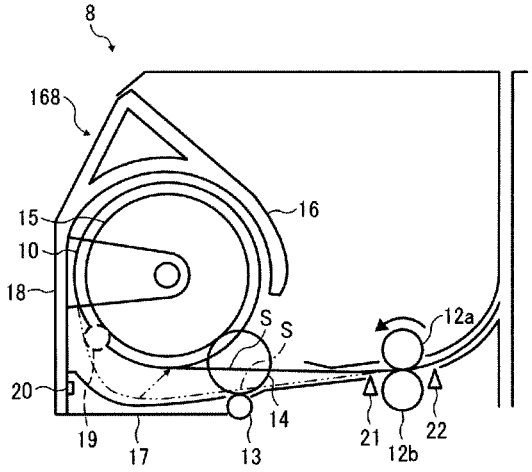
FIG. 8 shows the sheet supply device shown in FIG. 3 when a supply roller restarts rotating.

Then, in a condition in which the exit sensor 22 detects the recording sheet S and the cover sensor 20 detects that the protective cover 18 is in the closed state, when a printing instruction is received, as shown in FIG. 8, the supply roller 12*a* restarts rotating and conveys the recording sheet S to the sheet conveyance-driving roller 6*a* (see FIG. 1).

Subsequently, as described above, the image forming process, the cutting and separating process, and the rewinding process of the recording sheet S are performed.

In addition, as shown in FIG. 8, when the supply roller 12*a* restarts rotating, because a pulling force is exerted on the recording sheet S due to a conveyance force from the supply roller 12*a*, the position of the recording sheet S is moved from a position indicated by broken lines shown in FIG. 8, at which the recording sheet S is slackened, to a position indicated by solid lines shown in FIG. 8, at which the recording sheet S is stretched taut. That is, as the supply roller 12*a* rotates, the recording sheet S is moved to the supply route. At this time, because the upper guide 16 is at the escape position and is away from the supply route, the recording sheet S does not interfere with the upper guide 16.

Moreover, in the present embodiment, the upper guide 16 is at the escape position and is away from the supply area for the recording sheet S through which the supply route B (see FIG. 4) when the paper remaining in the roll of paper 10 is greatest is moved to the supply route C when the paper remaining in the roll of paper 10 is lowest, and therefore interference between the recording sheet S and the upper guide 16 can be prevented until the entire roll of paper 10 is consumed.

(Second Embodiment)

Next, a sheet-supply device 8A according to a second embodiment is described below with reference to FIGS. 9 through 13.

Figure 9:
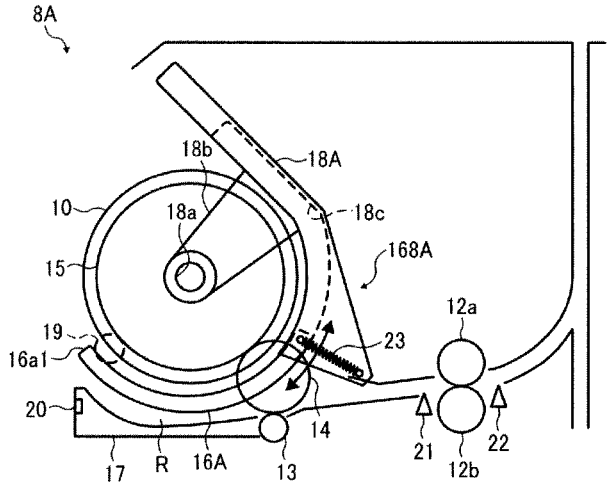
FIG. 9 is a schematic diagram illustrating a sheet-supply device according to a second embodiment when a protective cover is opened.
Figure 10:
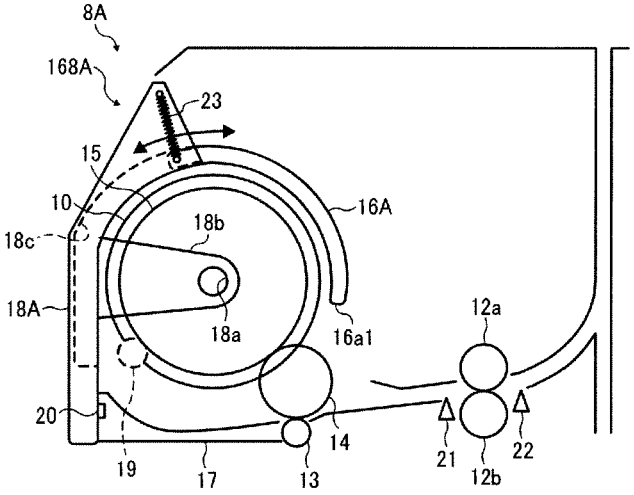
FIG. 10 is a schematic diagram illustrating the sheet-supply device shown in FIG. 9 when the protective cover is closed.

FIGS. 9 and 10 illustrate a configuration of the sheet-supply device 8A according to the present embodiment. FIG. 9 shows the sheet-supply device 8A when a protective cover 18A is opened, and FIG. 10 shows the sheet-supply device 8A when the protective cover 18A is closed.

In a cover unit 168A according to the second embodiment, the protective cover 18A is formed separately from an upper guide 16A, and the upper guide 16A is connected to the protective cover 18A via a spring 23 serving as an elastic extension member. The upper guide 16A is supported at a predetermined position relative to the protective cover 18A by a pull force from the spring 23.

More specifically, as shown in FIG. 9, when the protective cover 18A is opened, the upper guide 16A is held at the guide position at which the upper guide 16A guides the recording sheet S. As shown in FIG. 10, when the protective cover 18A is closed, the upper guide 16A is held at the escape position at which the upper guide 16A is away from the supply route of the recording sheet S.

In addition, a container 18*c* to accommodate the upper guide 16A is formed in the protective cover 18A. In the state shown in FIGS. 9 and 10, due to the pulling force from the spring 23, the upper guide 16A is kept in a state in which most of the upper guide 16A is exposed from the container 18*c*. However, when a pressing force to press the upper guide 16A into the container 18*c* is generated, the upper guide 16A is accommodated in the container 18*c* against the pulling force from the spring 23. Namely, the second embodiment is different from the first embodiment in that the upper guide 16A can move independently of the protective cover 18A.

It is to be noted that, for ease of explanation and illustration, because other than the difference described above the sheet-supply device 8A has a configuration similar to the configuration of the sheet-supply device 8 in the first embodiment, other components of the sheet-supply device 8A are given identical reference numerals and the description thereof is omitted below. In addition, because the installation process of the roll of paper 10 in the sheet-supply device 8A is similar to that of the sheet-supply device 8, the figures and the description thereof are omitted below.

Figure 11:
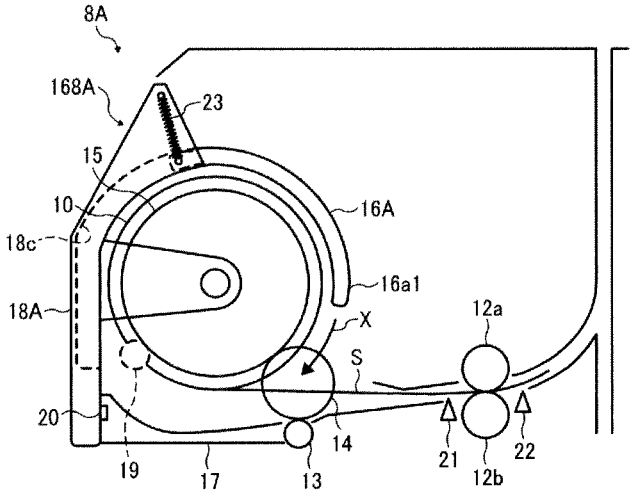
FIG. 11 shows the sheet-supply device shown in FIG. 9 when the roll of paper is installed therein so that a recording sheet can be supplied from a roll of paper.

FIG. 11 shows the sheet-supply device 8A when the roll of paper 10 is installed therein so that the recording sheet S can be supplied. In this state, the sheet-supply device 8A enters the standby state in which the distal end of the recording sheet S pulled out from the roll of paper 10 is clamped between the supply roller 12*a* and the supply-pressure roller 12*b*.

Figure 12:
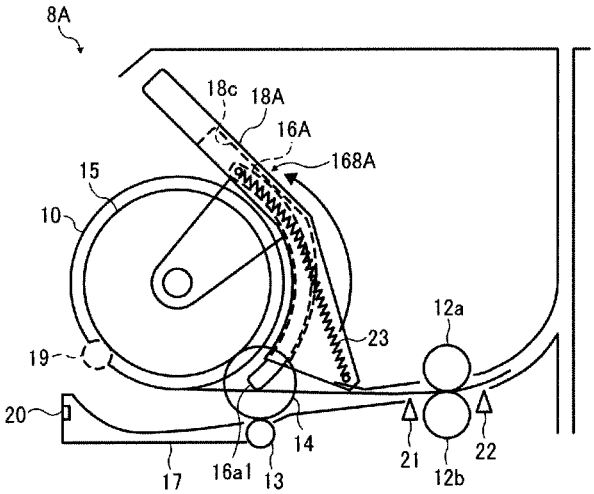
FIG. 12 shows the sheet-supply device shown in FIG. 9 when the protective cover is opened in a state in which the roll of paper is installed therein so that the recording sheet can be supplied.

When the protective cover 18A is opened, since the upper guide 16A moves in a moving direction indicated by arrow X shown in FIG. 11 (becomes the guide position), a front end 16*a*1 of the upper guide 16A in the moving direction contacts the recording sheet S. Subsequently, when the protective cover 18A is further moved in a direction in which the protective cover 18A is opened (hereinafter "open direction"), as shown in FIG. 12, the upper guide 16A receives a force from the contact with the recording sheet S, and then the upper guide 16A is accommodated into the container 18*c* in the protective cover 18A while extending the spring 23 in a direction indicated by an arrow shown in FIG. 12.

As described above, in the second embodiment, when the upper guide 16A is contacted with the recording sheet S by opening the protective cover 18A, the movement of the upper guide 16A in a contact direction in which the upper guide 16A moves to contact the recording sheet S is restricted by extending the spring 23. As a result, occurrence of the damaging the recording sheet S caused by contacting the upper guide 16A can be prevented.

Figure 13:
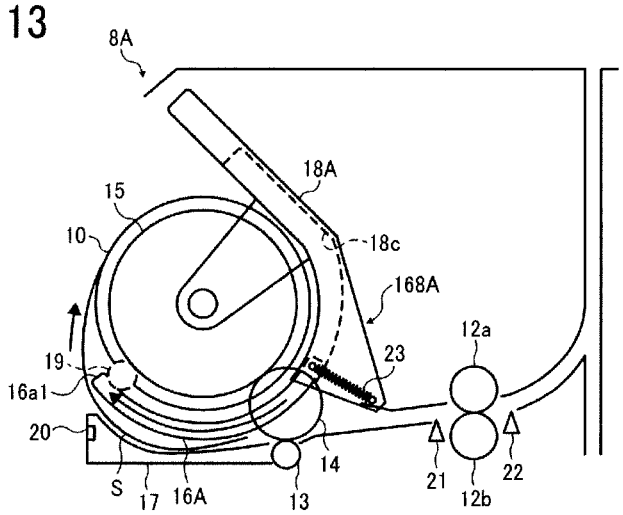
FIG. 13 shows an upper guide in the sheet-supply device shown in FIG. 9 when the recording sheet is rewound.
Figure 14:
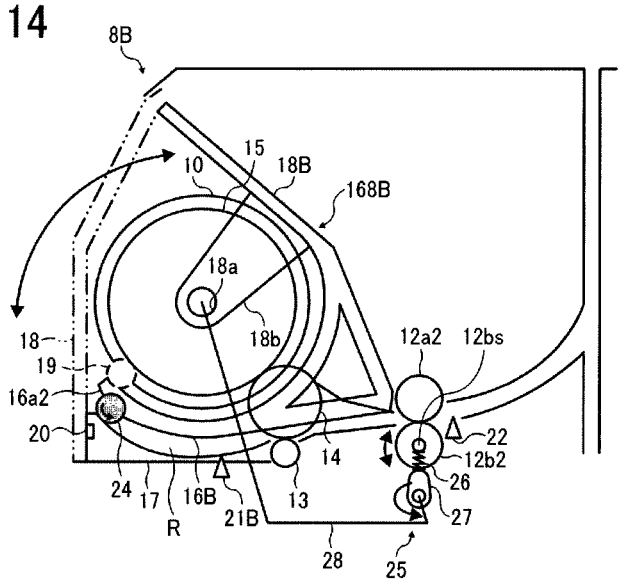
FIG. 14 is a schematic diagram illustrating a sheet-supply device according to a third embodiment.

Subsequently, as shown in FIG. 13, when the recording sheet S is rewound and is removed from between the sheet roller 12*a* and the supply-pressure roller 12*b*, a holding force to hold the distal end of the recording sheet S is lost, and therefore, the upper guide 16A is pulled out from the container 18*c* by the pull force from the spring 23 and is located at the guide position.

Thus, since the guide path R is formed between the upper guide 16A and the lower guide 17 in this state, the recording sheet S is guided to the supply roller 12*a* through the guide path R. Therefore, the recording sheet S can be supplied again.

(Third Embodiment)

Next, a sheet-supply device 8B according to a third embodiment is described below with reference to FIGS. 14 through 17.

In the third embodiment, a one-way rotating body 24 that is rotatable in only one direction in which the recording sheet S is sent to a supply roller 12*a*2 is disposed on a front end 16*a*2 of an upper guide 16B. In addition, differently from other embodiments, an entrance sensor 21B is positioned in front of the rewind roller 13.

In addition, the sheet-supply device 8B according to the third embodiment includes a contact-separation unit 25 that causes a supply-pressure roller 12*b*2 to contact the supply roller 12*a*2 and to move away from the supply roller 12*a*2. The contact-separation unit 25 functions as a contact-separation member. The contact-separation unit 25 includes a pressing spring 26 that presses the supply-pressure roller 12*b*2 to the supply roller 12*a*2 and a cam 27 that can release the pressure from the pressing spring 26. One end of the pressing spring 26 (top end in FIG. 14) contacts a support shaft 12*bs* of the supply-pressure roller 12*b*2. The other end of the pressing spring 26 (bottom end in FIG. 14) contacts the cam 27 that rotates eccentrically.

Further, in the third embodiment, the sheet-supply device 8B further includes a power transmission member 28 that rotates the cam 27 in conjunction with opening and closing of a protective cover 18B. The power transmission member 28 is formed of, for example, a timing belt and a gear. The power transmission member 28 causes the cam 27 to go into a 360-degree roll when the protective cover 18B is opened and is closed. It is to be noted that the configuration of the power transmission member 28 is not shown in detail in FIGS. 14 through 17.

In addition, similarly to the first embodiment, because the upper guide 16B according to the third embodiment is integrally formed with (connected to) the protective cover 18B in a cover unit 168B, as the protective cover 18B is opened and is closed, the upper guide 16B moves between the guide position and the escape position in conjunction with the protective cover 18B.

Therefore, in other words, the cam 27 is rotated in conjunction with the movement of the upper guide 16B. It is to be noted that, for ease of explanation and illustration, because other than the difference described above the sheet-supply device 8B has a configuration similar to the configuration of the sheet-supply device 8 in the first embodiment, other components of the sheet-supply device 8B are represented by identical numerals and the description thereof is omitted below.

Next, the installation of the roll of paper 10 into the sheet-supply device 8B is described below, with reference FIGS. 15 and 16.

Figure 15:
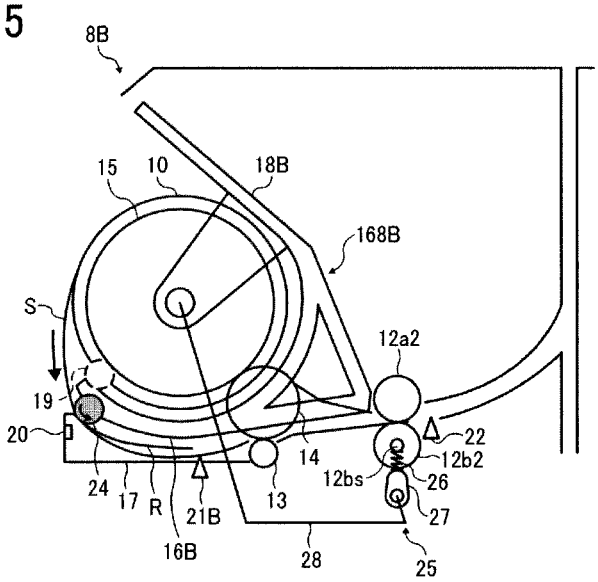
FIG. 15 shows movement of a one-way rotating body in the sheet-supply device shown in FIG. 14 when a recording sheet from a roll of paper is inserted into gap between guides.

Initially, as shown in FIG. 15, the protective cover 18B is opened, similarly to the first embodiment, and the roll of paper 10 is inserted into the sheet-supply device 8B. Subsequently, the recording sheet S pulled out from the roll of paper 10 is manually inserted into the guide path R formed between the upper guide 16B and the lower guide 17.

Then, the recording sheet S is sent along the guide path R until the entrance sensor 21B detects the recording sheet S. At this time, the one-way rotating body 24 provided in the upper guide 16B is rotated together with the movement of the sent recording sheet S. After the entrance sensor 21B detects the recording sheet S, the protective cover 18B is rotated in a direction in which the protective cover 18B is closed (hereinafter "closed direction").

It is to be noted that the sheet-supply device 8B may further include a reporting member that makes sound or emits light to report the detection of the entrance sensor 21B for an operator (user).

Figure 16:
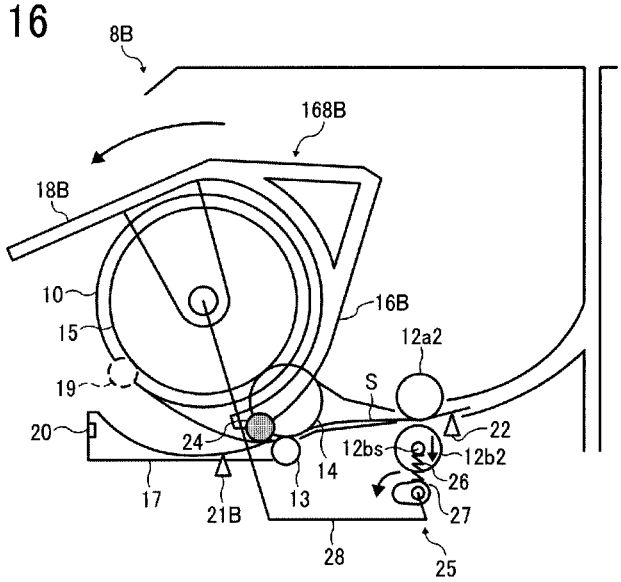
FIG. 16 shows the one-way rotating body and a cam in the sheet-supply device shown in FIG. 14 while a protective cover is closed.

As shown in FIG. 16, when the protective cover 18B is rotated in the closed direction, because the upper guide 16B moves to the escape position, the one-way rotating body 24 is moved further inside together with the upper guide 16B.

At this time, although a load acting a reverse direction to a direction in which the recording sheet S is supplied acts on the one-way rotating body 24 since the one-way rotating body 24 is moved while contacting a surface of the recording sheet S, the one-way rotating body 24 is prevented from rotating in the reverse direction to a direction in which the recording sheet S is supplied. Therefore, the one-way rotating body 24 that moves to the supply roller 12*a*2 sends the recording sheet S to the supply roller 12*a*2.

In addition, when the protective cover 18B is rotated in the closed direction, the driving force of the protective cover 18B is transmitted to the cam 27 via the power transmission member 28, and the cam 27 is rotated in a direction indicated in an arrow shown in FIG. 16.

When the cam 27 is rotated approximately 90 degrees, the pressure from the pressing spring 26 to the supply-pressure roller 12*b*2 is released and the supply-pressure roller 12*b*2 is separated from the supply roller 12*a*2. Then, the distal end of the recording sheet S sent from the one-way rotating body 24 is inserted into a space where the supply roller 12*a*2 is separated from the supply-pressure roller 12*b*2.

Figure 17:
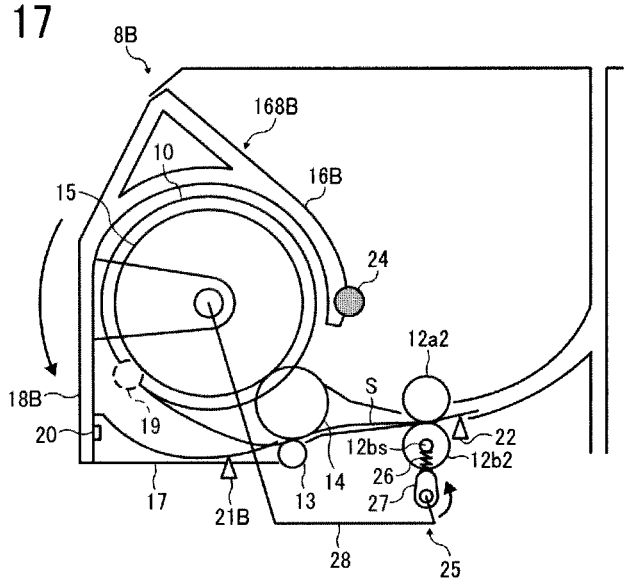
FIG. 17 shows the sheet-supply device shown in FIG. 14 when the protective cover is fully closed.

As shown in FIG. 17, when the protective cover 18B is fully closed, the upper guide 16B is at the escape position, and the one-way rotating body 24 is positioned away from the recording sheet S. In addition, while the protective cover 18B is fully closed, the cam 27 goes into a 360-degree roll, and returns to the initial state.

Thus, the pressing spring 26 presses the supply-pressure roller 12*b*2 again, and vicinity of the distal end of the recording sheet S is clamped between the supply-pressure roller 12*b*2 and the supply roller 12*a*2. In this state, the exit sensor 22 detects the distal end of the recording sheet S, and the cover sensor 20 detects that the protective cover 18B is closed.

Subsequently, when the printing instruction is received, because the supply roller 12*a*2 restarts rotating, the recording sheet S is conveyed to the conveyance-drive roller 6*a* (see FIG. 1).

As described above, in the third embodiment, when the protective cover 18B is closed, because the one-way rotating body 24 sends the recording sheet S to the supply roller 12*a*2, the amount of the recording sheet S manually fed by the operator can be reduced. Therefore, workability and the convenience can be improved.

In addition, it is preferable that a surface of the one-way rotating body 24 is formed of a material such as rubber that has high friction coefficient so that the slippage between the one-way rotating body 24 and the recording sheet S is prevented, and the recording sheet S is effectively sent. Further, in the third embodiment, because the supply roller 12*a*2 is separated from the supply-pressure roller 12*b*2 simultaneously with the close operation of the protective cover 18B, the recording sheet S can be easily inserted into the separation gap between the supply roller 12*a*2 and the supply-pressure roller 12*a*2, and the operability can be improved.

(Fourth Embodiment)

Next, a sheet-supply device 8C according to a fourth embodiment is described below with reference to FIGS. 18 and 19.

Figure 18:
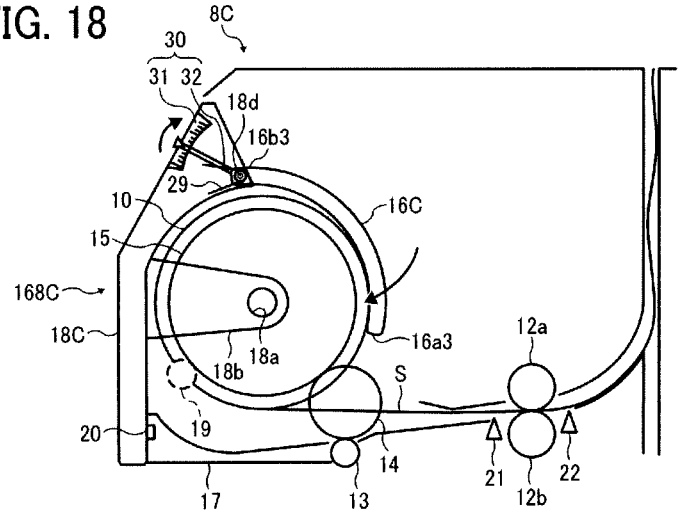
FIG. 18 is a schematic diagram illustrating a configuration of a sheet-supply device according to a fourth embodiment.

FIG. 18 shows a configuration of the sheet-supply device 8C according to the fourth embodiment. In a cover unit 168C according to the fourth embodiment, the protective cover 18C is formed separately from an upper guide 16C, and an inner end 16*b*3 of the upper guide 16C is rotatably attached to the protective cover 18C around a support shaft 18*d* that extends in a horizontal direction. In addition, a twisted coil spring 29, serving as a pressing member to press the upper guide 16C to the roll of paper 10 is attached to the support shaft 18*d*. Due to pressing force from the twisted coil spring 29, an outer end 16*a*3 of the upper guide 16C contacts the outer circumferential surface of the roll of the paper 10.

With this configuration, the upper guide 16C can follow and contact the outer circumferential surface of the roll of paper 10 even though the amount of paper remaining in the roll of paper is reduced and accordingly an outer diameter of the roll of paper 10 becomes gradually smaller as the recording sheet S in the roll of paper 10 is consumed. That is, the outer end 16*a*3 of the upper guide 16C that contacts the recording sheet S is movable in a radial direction of the roll of paper 10, in accordance with the amount of paper remaining in the roll of paper 10.

In addition, the sheet-supply device 8C according to the fourth embodiment further includes a remaining paper indicator 30. More specifically, the remaining paper indicator 30 includes a remaining paper gauge 31 provided inside the protective cover 18C and an indicator needle 32 fixed on the inner end 16*b*3 provided in the rotary center side of the upper guide 16C (or the support shaft 18*d*).

When the paper remaining in the roll of the paper 10 is reduced as the recording sheet S in the roll of paper 10 is supplied, the upper guide 16C is moved toward the radial center following the outer circumferential surface of the roll of paper 10. At this time, the indicator needle 32 displays the amount of paper remaining in the roll of paper 10 in the remaining paper gauge 31 in accordance with the travel distance of the upper guide 16C in the radial direction of the roll of paper 10.

Figure 19:
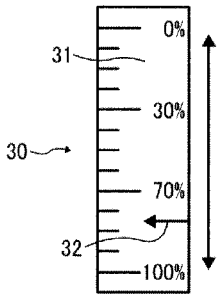
FIG. 19 is an expanded diagram illustrating a remaining paper gauge in the sheet supply device shown in FIG. 18.
Figure 20:
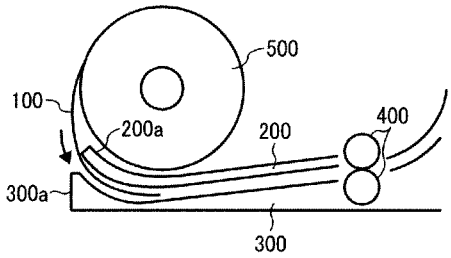
FIG. 20 RELATED ART
FIG. 20 is a schematic diagram illustrating a known sheet-supply device.
Figure 21A:
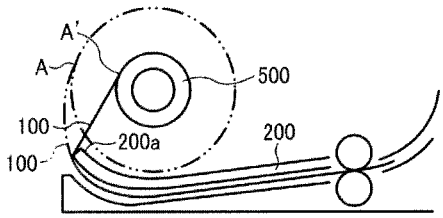
FIG. 21A RELATED ART
FIG. 21A shows the sheet-supply device shown in FIG. 20 when sheet remaining in a roll is reduced.
Figure 21B:
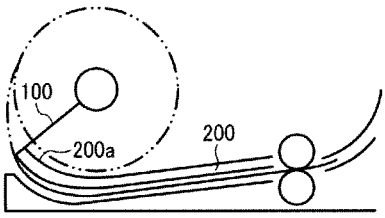
FIG. 21B RELATED ART
FIG. 21B shows the sheet-supply device shown in FIG. 20 when the sheet is fully unreeled from the roll.
Figure 22:
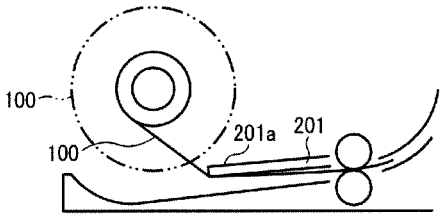
FIG. 22 RELATED ART
FIG. 22 is a schematic diagram illustrating another known sheet-supply device.

FIG. 19 is an expanded diagram illustrating the remaining paper gauge 31. In a configuration shown in FIG. 19, 100%, 70%, 30%, and 0%, representing the amount of the paper remaining in the roll of paper 10, are marked on the remaining paper gauge 31 from bottom up. The indicator needle 32 moves from bottom up as the remaining in the roll of paper 10 is reduced.

As described above, in the fourth embodiment, because the upper guide 16C also functions as a detector to detect the amount of paper remaining in the roll of paper 10, there is no need to provide another detector to detect the amount of remaining in the roll of paper 10 in the sheet-supply device 8C. Accordingly, the number of components can be reduced and the structure of the sheet-supply device 8C can be simplified, which can reduce the cost of the sheet-supply device.

In addition, if the sheet-supply device 8C does not include the remaining paper indicator 30 including the remaining display scale 31 and the indicator needle 32, in order to visually detect the roll of paper 10, a relatively wide range of the protective cover 18C must be transparent or semitransparent. However, in the present embodiment, the transparence area is required for only a range within which the remaining paper indicator 30 can be seen from outside, and the transparence area can be smaller. In addition, in the fourth embodiment, other than the difference described above, the sheet-supply device 8C has a configuration similar to the configuration of the sheet-supply device 8 in the first embodiment. Therefore, when the protective cover 18 is opened, the upper guide 16C is at the guide position at which the recording sheet S is guided. When the protective cover 18 is closed, the upper guide 16C is at the escape position at which escaping the supply route of the recording sheet S.

It is to be noted that the although only the upper guide 16 is moved between the guide position and the escape position in the above-described embodiment, the sheet-supply device according to the present specification can adopt a configuration in which the lower guide 17 or the both upper guide 16 and lower guide 17 can be moved between the guide position and the escape position.

In addition, the supply-able sheet in the sheet-supply device is not limited, and sheets of resin sheet or some other recording material can be adapted in the present specification.

In the above-described embodiments, by moving the upper guide to the escape position, the upper guide can be away from the supply path of the recording sheet. Then, despite the shifting of the paper supply path of the recording sheet as the paper is consumed and the roll gets smaller, the upper guide does not interfere with the recording sheet. Therefore, damage to the recording sheet from interference with the upper guide can be prevented.

In addition, according to the configuration of the present specification, interference between the recording sheet and the upper guide can be prevented even when the upper guide is formed relatively long. For this reason, the upper guide can be extended to a position at which the upper guide can see from outside. Accordingly, when the recording sheet is set, it is easily confirmed that the recording sheet is guided by the upper guide and the lower guide, and as a result, the workability of the installation in the recording sheet and visibility when the sheet is set in a sheet-supply device in an image forming apparatus can be improved.

In addition, the degree of visibility of the upper guide is low from outside when a roll of paper is set in a configuration in which the roll of paper is provided in the front of the main body of the printer and the supply roller is provided backside from the main body of the printer. However, in the above-described sheet-supply device installed in the image forming apparatus, workability and visibility when the sheet is set in a sheet-supply device in an image forming apparatus can be significantly improved.

Numerous additional modifications and variations are possible in light of the above teachings. It is therefore to be understood that, within the scope of the appended claims, the disclosure of this patent specification may be practiced otherwise than as specifically described herein.

What is claimed is:

1. A sheet-supply device internally defining a supply route through which to supply a sheet, the sheet-supply device comprising:

a supply member to supply the sheet from a rolled long sheet; and a guide member to guide the sheet to the supply member, provided upstream a direction in which the sheet is moved to the supply member and movable between a guide position at which the sheet is guided to the supply member and an escape position at which the guide member is away from the supply route of the sheet, wherein the guide member is configured and disposed to move in a direction along an outer circumferential surface of the rolled long sheet which is rolled around a roll member.

2. The sheet-supply device according to claim 1, further comprising:

an openably closable protective cover, connected to the guide member, to protect the rolled long sheet and move in conjunction with the guide member, wherein the protective cover and the guide member together form a cover unit, the guide member moves to the guide position when the protective cover is opened, and the guide member moves to the escape position when the protective cover is closed.

3. The sheet-supply device according to claim 1, further comprising:

an openably closable protective cover to protect the rolled long sheet, moving independently of the guide member; and an elastic extension member to connect the guide member o the protective cover and to hold the guide member at the guide position when the protective cover is opened and at the escape position the protective cover is closed.

4. The sheet-supply device according to claim 1, further comprising:

a one-way rotating body, rotatable in only one direction in which the sheet is supplied to the supply member, to move to the supply member side while contacting with the sheet from he rolled long sheet when the guide member is moved from the guide position o the escape position.

5. The sheet-supply device according to claim 4, wherein the supply member comprises a pair of rotary members to clamp and convey the sheet, the sheet-supply device further comprising a contact-separation member that disengages the pair of rotary members from each other when the guide member is moved from the guide position to the escape position.

6. The sheet-supply device according to claim 5, wherein the rotary members of the supply embers are disengaged from each other in conjunction with the movement of the guide member from the guide state to the escape state.

7. The sheet-supply device according to claim 1, wherein the guide member contacts an outer circumferential face of the rolled long sheet and is movable in a radial direction of the rolled long sheet in accordance with the amount of rolled long sheet remaining, the sheet-supply device further comprising a remaining paper indictor to display the amount of the rolled long sheet remaining based on the travel distance of the guide member in the radial direction of the rolled long sheet.

8. A sheet-supply device internally defining a supply route through which to supply a sheet, the sheet-supply device comprising:

a supply member to supply the sheet from a rolled long sheet;

a cover unit to pivot around the rolled long sheet, provided upstream a direction in which the sheet is moved to the supply member;

the cover unit comprising:

a guide member to guide the sheet to the supply member, and a protective cover to protect the rolled long sheet, connected to the guide member, wherein the cover unit movable between a guide position at which the sheet is guided to the supply member and an escape position at which the guide member s away from the supply route of the sheet, and wherein the cover unit is configured and disposed to move in a direction along an outer circumferential surface of the rolled long sheet which is rolled around a roll member.

9. The sheet-supply device according to claim 8, wherein the guide member in the cover unit moves to the guide position when the cover unit pivots in a direction in which the protective cover s opened and the guide member of the cover unit moves to the escape position when the cover unit pivots in a direction in which the protection cover s closed.

10. An image forming apparatus comprising:

an image forming device to perform image formation on a sheet; and a sheet-supply device internally defining a supply route through which to supply the sheet, the sheet-supply device comprising:

a supply member to supply the sheet from o d long sheet o the image forming device; and a guide member to guide the sheet to the supply member, provided upstream from the supply member in a direction in which the sheet is moved to the supply member, and movable between a guide position at which the sheet is guided to the supply member and an escape position at which the guide member is away from the supply route of the sheet, wherein the guide member is configured and disposed to move in a direction along an outer circumferential surface of the rolled long sheet which is rolled around a roll member.

11. The image forming apparatus according to claim 10, further comprising:

an openably closable protective cover provided in the cover unit, connected to the guide member, to protect the rolled long sheet and move in conjunction with the guide member, wherein the protective cover and the guide member together form a cover unit, the guide member moves to the guide position when the protective cover is opened, and the guide member moves to the escape position when the protective cover is closed.

12. The image forming apparatus according to claim 10, further comprising:

an openably closable protective cover, provided in the sheet-supply device, to protect the rolled long sheet and move independently from the guide member; and an elastic extension member, provided in the sheet-supply device, to connect the guide member to the protective cover, to hold the guide member at the guide position when the protective cover is opened and at the escape position when the protective cover is closed.

13. The image forming apparatus according to claim 10, further comprising:

a one-way rotating body, provided in the sheet-supply device, rotatable in only one direction in which the sheet is supplied to the supply member, to move to the supply member side while contacting with the sheet unreeled from the rolled long sheet when the guide member is moved from the guide position to the escape position.

14. The image forming apparatus according to claim 10, wherein the supply member in the sheet-supply device comprises a pair of rotary member to clamp and convey the sheet, and the sheet-supply device comprises a contact-separation member to causes the pair of rotary members to disengage from each other when the guide member is moved from the guide position to the escape position.

15. The image forming apparatus according to claim 14, wherein the pair of rotary members of the supply members in the sheet-supply device is disengaged from each other in conjunction with the movement of the guide member from the guide position to the escape position.

16. The sheet-supply device according to claim 10, wherein the guide member in the sheet-supply device contacts an outer circumferential surface of the rolled long sheet and movable in a radial direction of the rolled long sheet in accordance with the amount of the rolled long remaining, the sheet-supply device further comprising a remaining paper indictor to display the amount of the rolled long sheet remaining based on the travel distance of the guide member in the radial direction of the rolled long sheet.

* * * * *